US010316592B2

(12) United States Patent
Chen

(10) Patent No.: US 10,316,592 B2
(45) Date of Patent: Jun. 11, 2019

(54) CUTTER FOR USE IN WELL TOOLS

(71) Applicant: HALLIBURTON ENERGY SERVICES, INC., Houston, TX (US)

(72) Inventor: Shilin Chen, Montgomery, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 609 days.

(21) Appl. No.: 14/365,952

(22) PCT Filed: Sep. 10, 2013

(86) PCT No.: PCT/US2013/058903
§ 371 (c)(1),
(2) Date: Jun. 16, 2014

(87) PCT Pub. No.: WO2014/043071
PCT Pub. Date: Mar. 20, 2014

(65) Prior Publication Data

US 2015/0000988 A1 Jan. 1, 2015

Related U.S. Application Data

(60) Provisional application No. 61/699,405, filed on Sep. 11, 2012.

(51) Int. Cl.
*E21B 10/55* (2006.01)
*E21B 10/567* (2006.01)
(Continued)

(52) U.S. Cl.
CPC ..... *E21B 10/5673* (2013.01); *B24D 18/00* (2013.01); *E21B 10/55* (2013.01);
(Continued)

(58) Field of Classification Search
CPC combination set(s) only.
See application file for complete search history.

(56) References Cited

U.S. PATENT DOCUMENTS 3,153,458 A 10/1964 William
4,339,009 A 7/1982 Busby
(Continued)

FOREIGN PATENT DOCUMENTS

| | | | |
|---|---|---|---|
| EP | 0211642 | 2/1987 | |
| EP | 0546725 | 6/1993 | ..... E21B 10/56 |
| GB | 2268768 | 1/1994 | |

OTHER PUBLICATIONS

International Search Report and Written Opinion dated Nov. 22, 2013 for PCT Patent Application No. PCT/US13/058903, 15 pages.
(Continued)

*Primary Examiner* — D. Andrews
*Assistant Examiner* — Ronald R Runyan
(74) *Attorney, Agent, or Firm* — Baker Botts L.L.P.

(57) ABSTRACT

A well tool can include a cutter with at least one cutting layer and a substrate, the cutting layer having a leading face, and the substrate partially overlying the leading face. A method of constructing a well tool can include forming a cutter by at least partially embedding at least one cutting layer in a substrate, and securing the cutter to the well tool. A drill bit can include a drill bit blade, and a cutter secured on the drill bit blade, the cutter including a substrate and at least one cutting layer embedded in the substrate, the substrate overlying leading and trailing faces of the cutting layer.

29 Claims, 14 Drawing Sheets

(51) Int. Cl.
*E21B 10/573* (2006.01)
*B24D 18/00* (2006.01)

(52) U.S. Cl.
CPC ..... *E21B 10/567* (2013.01); *E21B 10/573* (2013.01); *E21B 10/5735* (2013.01)

(56) References Cited

U.S. PATENT DOCUMENTS 4,499,959 A * 2/1985 Grappendorf ..... E21B 47/18 175/405.1
4,780,274 A 10/1988 Barr
4,997,049 A * 3/1991 Tank ..... B23B 27/141 175/430
5,379,854 A * 1/1995 Dennis ..... E21B 10/5673 175/426
5,487,436 A 1/1996 Griffin
5,605,198 A * 2/1997 Tibbitts ..... E21B 10/43 175/432
5,871,060 A 2/1999 Jensen et al.
5,944,129 A * 8/1999 Jensen ..... E21B 10/567 175/430
6,315,066 B1 11/2001 Dennis
7,426,969 B2 9/2008 Azar
2006/0032677 A1 2/2006 Azar et al.
2006/0144621 A1 7/2006 Tank et al.
2006/0207802 A1 9/2006 Zhang et al.
2007/0278017 A1* 12/2007 Shen ..... E21B 10/5673 175/426
2008/0302577 A1* 12/2008 Pile ..... E21B 10/325 175/427
2011/0171444 A1* 7/2011 Elkouby ..... C23C 14/024 428/216

OTHER PUBLICATIONS

Warren, T.M. et al. "Torsional Resonance of Drill Collars with PDC Bits in Hard Rock", SPE49204, dated Sep. 27-30, 1998, 13 pages.
Extended European Search Report dated Aug. 16, 2016 for Application No. 13836464.1; 8 pages.
Office Action received for Canadian Application No. 2884374, dated Apr. 11, 2016; 4 pages.
International Preliminary Report on Patentability issued in PCT/US2013/058903; 12 pages, dated Mar. 26, 2015.
Office Action received for Canadian Application No. 2884374, dated Feb. 6, 2017; 4 pages.

* cited by examiner

CUTTER FOR USE IN WELL TOOLS

CROSS-REFERENCE TO RELATED APPLICATIONS

This application is a national stage under 35 USC 371 of International Application No. PCT/US13/58903, filed on 10 Sep. 2013, which claims priority to a U.S. Provisional Application No. 61/699,405, filed on 11 Sep. 2012. The entire disclosures of these prior applications are incorporated herein by this reference.

TECHNICAL FIELD

This disclosure relates generally to equipment utilized and operations performed in conjunction with a subterranean well and, in one example described below, more particularly provides a cutter for use in well tools.

BACKGROUND

Well tools (such as, drill bits and reamers) can include cutters for cutting into formation rock. However, in some situations, cutters can become damaged. Damaged cutters can reduce a rate of penetration through formation rock and can require time-consuming (and, thus, expensive) replacement. Therefore, it will be appreciated that improvements are continually needed in the art of constructing cutters for use in well tools.

DETAILED DESCRIPTION

Figure 1:
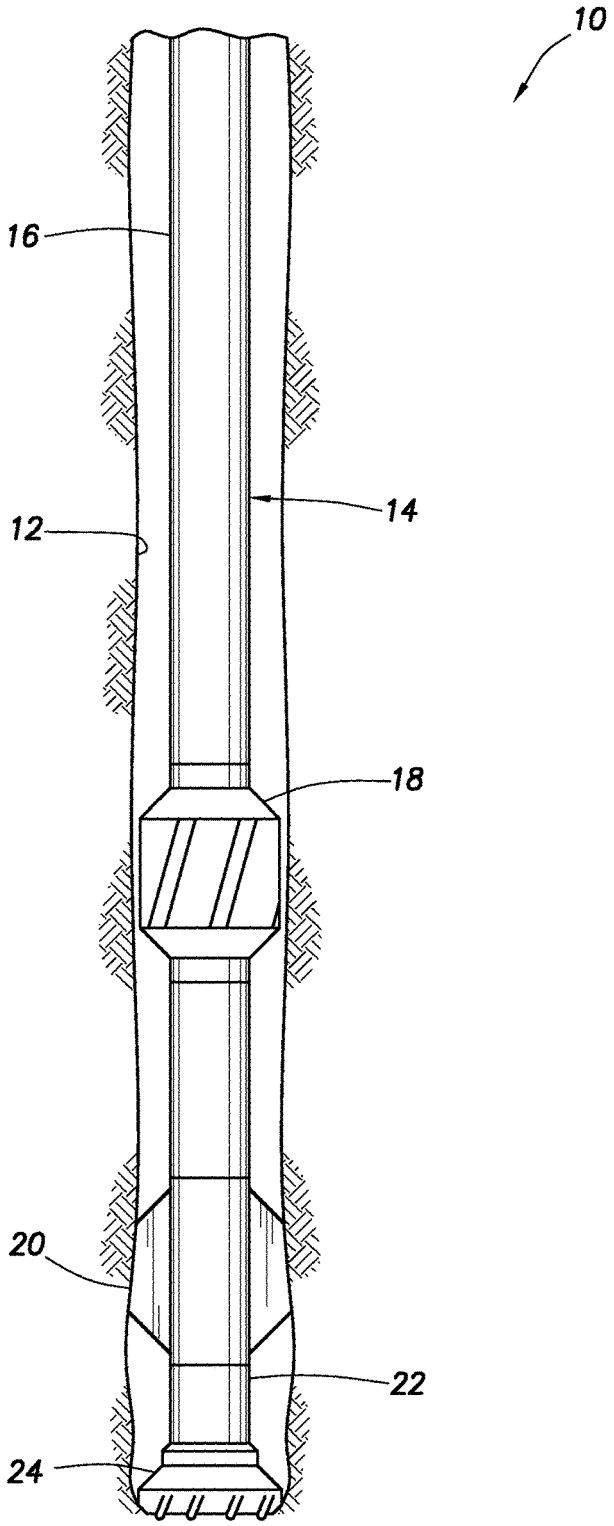
FIG. 1 is a representative partially cross-sectional view of a well system and associated method which can embody principles of this disclosure.

Representatively illustrated in FIG. 1 is a system 10 and associated method which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a wellbore 12 is being drilled with a drill string 14. The drill string 14 includes various well tools 16, 18, 20, 22, 24. In this example, the well tool 16 comprises one or more drill collars, the well tool 18 is a stabilizer, the well tool 20 is a reamer, the well tool 22 is an adapter or crossover, and the well tool 24 is a drill bit.

Many other well tools could be included in the drill string 14. Different combinations, arrangements and numbers of well tools can be used in other examples. Therefore, the scope of this disclosure is not limited to any particular type, number, arrangement or combination of well tools.

The well tool 24 is used as an example in the further description below to demonstrate how the principles of this disclosure can be applied in actual practice. However, it should be clearly understood that the scope of this disclosure is not limited to manufacture of drill bits or any other particular type of well tool. Any well tool which includes one or more cutting structures may potentially benefit from the principles of this disclosure.

Figure 2:
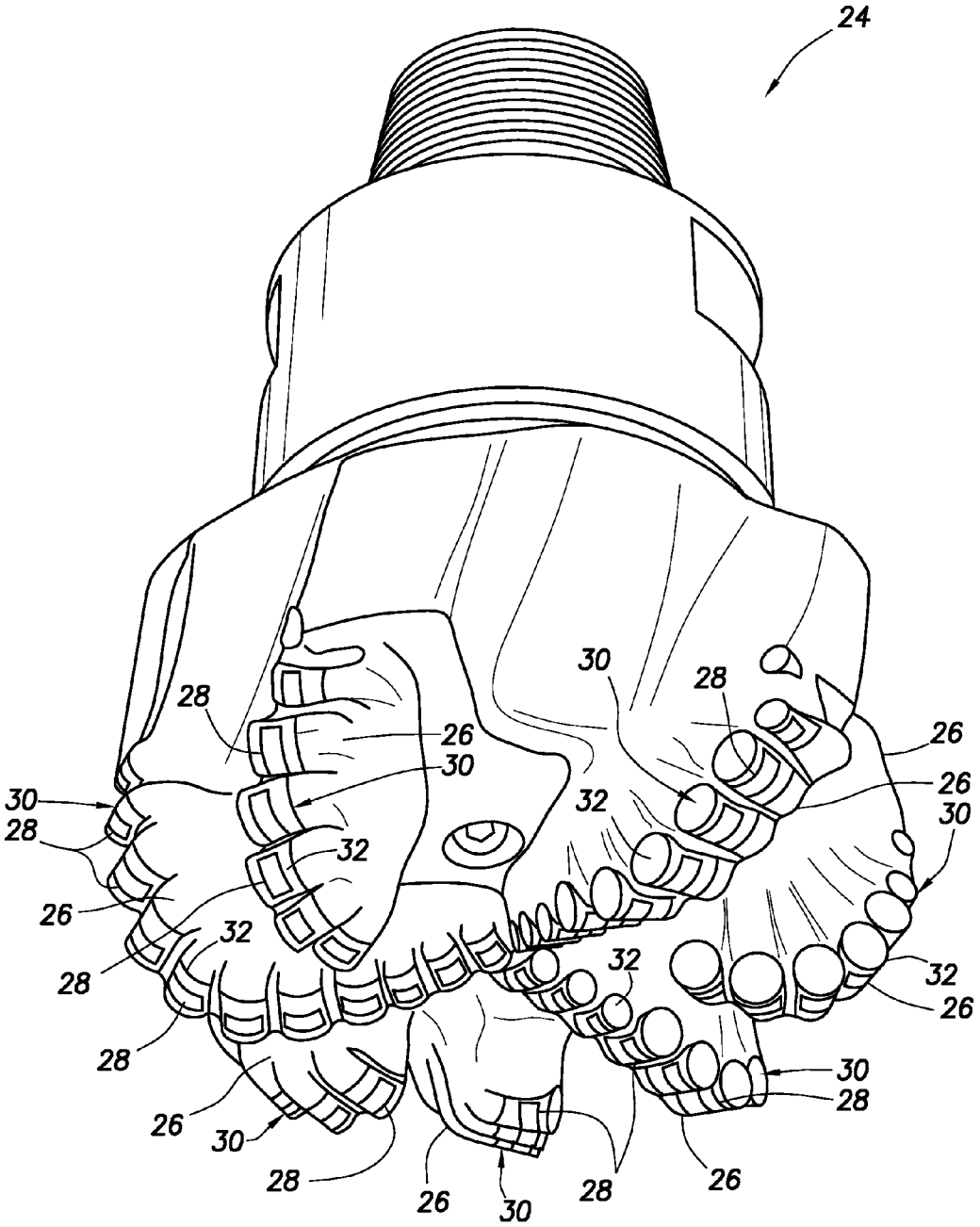
FIG. 2 is a representative perspective view of a drill bit which may be used in the system and method of FIG. 1, and which can embody the principles of this disclosure.

FIG. 2 is a representative perspective view of the drill bit (well tool 24) which may be used in the system 10 and method of FIG. 1, and which can embody the principles of this disclosure. Of course, the drill bit may be used in other systems and methods, in keeping with the principles of this disclosure.

In FIG. 2, it may be seen that the well tool 24 is of the type known to those skilled in the art as a fixed cutter drill bit. However, other types of drill bits (e.g., coring bits, "impregnated" bits, etc.) can be used in other examples.

The drill bit depicted in FIG. 2 includes multiple downwardly and outwardly extending blades 26. Each blade 26 has mounted thereon multiple cutters 30, each of which includes a cutting layer 28 embedded in a substrate 32.

The cutting layer 28 can comprise a polycrystalline diamond compact (PDC) "insert," and the substrate 32 can comprise a tungsten carbide material. However, the scope of this disclosure is not limited to any particular materials and/or structures used in the cutters 30.

Figure 3:
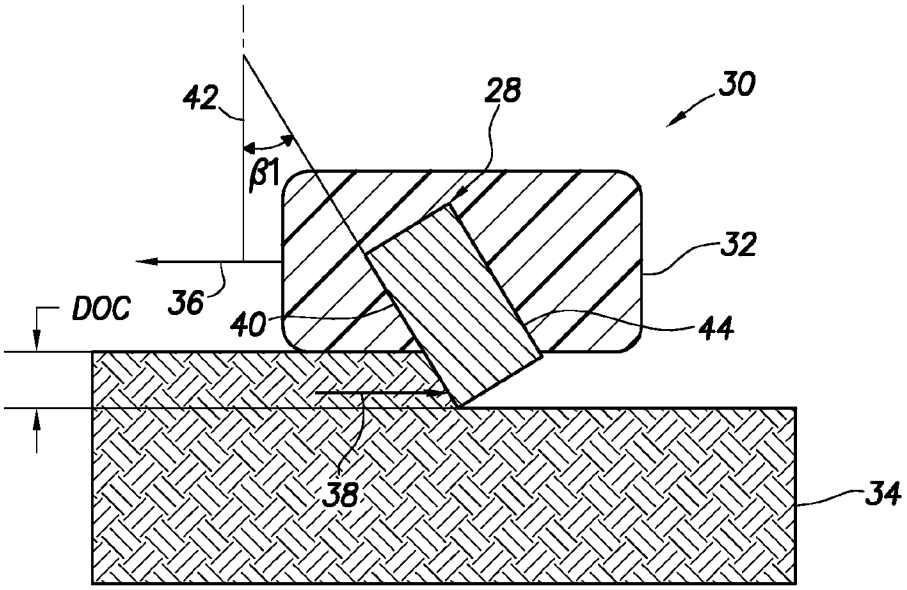
FIG. 3 is a representative cross-sectional view of a cutter of a well tool cutting into a formation rock.

FIG. 3 is a representative cross-sectional view of one of the cutters 30 of the well tool 24 cutting into a formation rock 34. For clarity of illustration and description, the cutter 30 is depicted in FIG. 3 apart from a remainder of the well tool 24.

In the FIG. 3 example, the cutter 30 is displacing to the left (as indicated by arrow 36) in its normal direction of travel (i.e., in a direction corresponding to how the well tool 24 is configured for use in cutting into the formation rock 34). Typically, drill bits designed for use in wells are configured for right-hand or clockwise rotation and so, viewed from a side of a drill bit, a cutter thereof would appear to be displacing to the left. However, the scope of this disclosure is not limited to any particular direction of displacement of the cutter 30.

With the cutter 30 displacing to the left as viewed in FIG. 3, a force 38 will be applied to a leading face 40 of the cutting layer 28. The face 40 is termed a "leading" face since, with the cutter 30 displacing in its normal direction of travel, the face 40 contacts and cuts into the formation rock 34.

In the FIG. 3 example, the leading face 40 is angled relative to a vertical (as depicted in FIG. 3) line 42 by an angle β1 known to those skilled in the art as a back rake angle (typically approximately 10 to 30 degrees). A depth of cut DOC of the cutter 30 is, in this example, equal to a distance by which the cutting layer 28 protrudes from the substrate 32.

Note that, opposite the leading face 40 on the cutting layer 28 is a trailing face 44. In this example, the leading and trailing faces 40, 44 comprise circular planar surfaces on the cutting layer 28, which is in the form of a solid cylinder, and the leading and trailing faces are parallel to each other. However, the scope of this disclosure is not limited to any particular shapes or orientation of the cutting layer 28 and/or leading and trailing faces 40, 44.

The substrate 32 completely covers the trailing face 44 and partially covers the leading face 40. In this manner, the substrate 32 can support the cutting layer 28 whether the cutter 30 is displacing in its normal direction (as indicated by arrow 36), or in a reverse direction.

With the cutter 30 displacing as depicted in FIG. 3, the substrate 32 in contact with the trailing face 44 will react the force 38 produced by the cutting layer 28 cutting into the formation rock 34 (the substrate in contact with the trailing face will be placed in compression). In addition, if the cutter 30 should inadvertently displace in a reverse direction while contacting the formation rock 34 (such as, due to torsional vibration, stick-slip or whirling of the well tool 24), an oppositely directed force produced by such displacement will be reacted by the substrate 32 in contact with the leading face 40 (the substrate in contact with the leading face will be placed in compression).

Thus, no matter the direction in which the cutter 30 contacts the formation rock 34, the cutting layer 28 is supported by the substrate 32 in compression. This feature of the cutter 30 can substantially reduce the incidence of chipping or cracking of the cutting layer 28, and substantially reduce separation of the cutting layer from the substrate 32.

Figure 5:
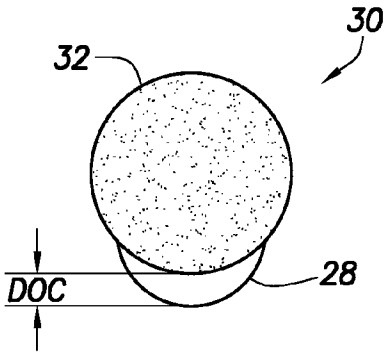
FIGS. 4 & 5 are representative perspective and end views, respectively, of the cutter of FIG. 3.
Figure 4:
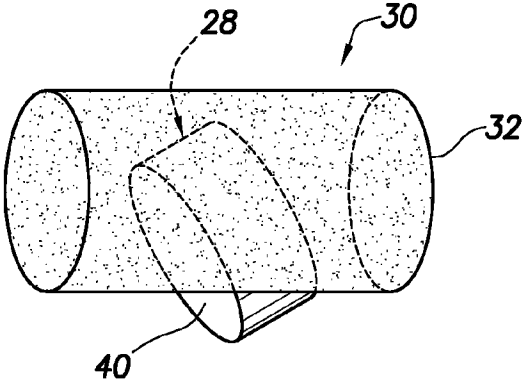

FIGS. 4 & 5 are representative perspective and end views, respectively, of the cutter of FIG. 3. In these views, the manner in which the cutting layer 28 is embedded in the substrate 32, and the manner in which the depth of cut DOC is determined by a distance by which the cutting layer extends outward from the substrate can be clearly seen.

In FIGS. 3 & 4, it may be seen that the cutting layer 28 is positioned at approximately a longitudinal middle of the substrate 32. In other examples, the cutting layer 28 could be positioned more forward or more rearward relative to the substrate 32.

In a method of manufacturing the cutter 30, the cutting layer 28 can be separately formed, and then embedded in a powdered tungsten carbide matrix material appropriately placed in a mold. A jig can be used to position the cutting layer 28 in the mold. The matrix material can then be sintered.

Suitable tungsten carbide materials include D63™ and PREMIX 300™, marketed by HO Starck of Newton, Mass. USA. Various types of tungsten carbide may be used, including, but not limited to, stoichiometric tungsten carbide particles, cemented tungsten carbide particles, and/or cast tungsten carbide particles. Other matrix materials may be used, as well.

The matrix material can comprise a blend of matrix powders. A binding agent (such as, copper, nickel, iron, alloys of these, an organic tackifying agent, etc.) can be mixed with the matrix material prior to loading the matrix material into the mold.

An effective binding agent can be any material that would bind, soften or melt at the sintering temperatures, and not burn off or degrade at those temperatures. High-temperature binding agents can comprise compositions having softening temperatures of about 260° C. (500° F.) and above. As used herein, the term "softening temperature" refers to the temperature above which a material becomes pliable, which is typically less than a melting point of the material.

Examples of suitable high-temperature binding agents can include copper, nickel, cobalt, iron, molybdenum, chromium, manganese, tin, zinc, lead, silicon, tungsten, boron, phosphorous, gold, silver, palladium, indium, titanium, any mixture thereof, any alloy thereof, and any combination thereof. Non-limiting examples may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, and the like. Further, high-temperature binding agents may include diamond catalysts, e.g., iron, cobalt and nickel.

Certain matrix materials may not require binding agents. Matrix powders comprising iron, nickel, cobalt or copper can bond through solid state diffusion processes during the sintering process. Other matrix materials that have very high melting temperatures (e.g., W, WC, diamond, BN, and other nitrides and carbides) may utilize a binding agent, because the high temperatures which produce solid state diffusion may be uneconomical or undesirable.

It is not necessary for the matrix material to comprise tungsten carbide. A matrix powder or blend of matrix powders useful here generally lends erosion resistance to a resulting hard composite material, including a high resistance to abrasion and wear. The matrix powder can comprise particles of any erosion resistant materials which can be bonded (e.g., mechanically) with a binder to form a hard composite material. Suitable materials may include, but are not limited to, carbides, nitrides, natural and/or synthetic diamonds, steels, stainless steels, austenitic steels, ferritic steels, martensitic steels, precipitation-hardening steels, duplex stainless steels, iron alloys, nickel alloys, cobalt alloys, chromium alloys, and any combination thereof.

Binder materials may cooperate with the particulate material(s) present in the matrix powders to form hard composite materials with enhanced erosion resistance. A suitable commercially available binder material is VIRGIN BINDER 453D™ (copper-manganese-nickel-zinc), marketed by Belmont Metals, Inc.

The binder material may then be placed on top of the mold, and may be optionally covered with a flux layer. A cover or lid may be placed over the mold as necessary. The mold assembly and materials disposed therein may be preheated and then placed in a furnace.

When the melting point of the binder material is reached, the resulting liquid binder material infiltrates the matrix powder. The mold may then be cooled below a solidus temperature of the binder material to form the hard composite material. Additional details of an example method of forming a hard, erosion and impact resistant tungsten carbide structure can be found in International Application No. PCT/US12/39925, entitled "Manufacture of Well Tools with Matrix Materials."

After the cutter 30 is removed from the mold, it can be secured onto a blade 26 (see FIG. 1) by, for example, brazing. Other techniques may be used for securing the cutter 30 to a blade 26 or other structure of the well tool 24, or for securing the cutter to other types of well tools (such as, the well tool 20—a reamer).

Other manufacturing procedures may be used for constructing the cutter 30. For example, the cutting layer 28 could be press-fit into the substrate 32, or other mechanical attachment methods or bonding techniques could be used. Thus, the scope of this disclosure is not limited to any particular process for manufacturing the cutter 30.

FIGS. 6-9 are representative cross-sectional views of additional configurations of the cutter 30. These configurations are similar in most respects to the configuration of FIGS. 3-5, but differ in some significant respects discussed below.

Figure 6:
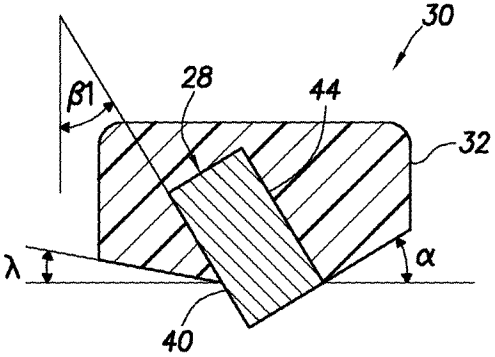

In FIG. 6, the substrate 32 is angled upward (as viewed in FIG. 6) away from the cutting layer 28. The angles $\lambda$ and $\alpha$ can be varied to produce correspondingly varied depths of cut.

Figure 7:
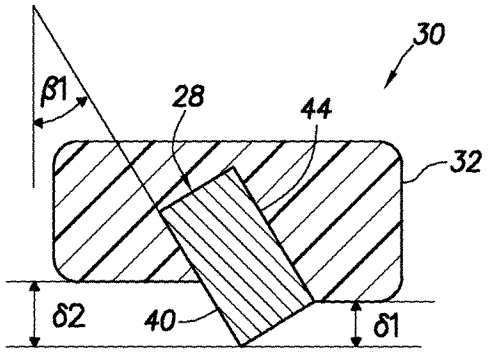
FIGS. 6-9 are representative cross-sectional views of additional configurations of the cutter.

In FIG. 7, the substrate is spaced farther from a lower edge of the cutting layer 28 on a leading side of the cutting layer, as compared to on a trailing side of the cutting layer. The spaced distances $\delta 1$ and $\delta 2$ can be varied to produce correspondingly varied depths of cut.

Figure 8:
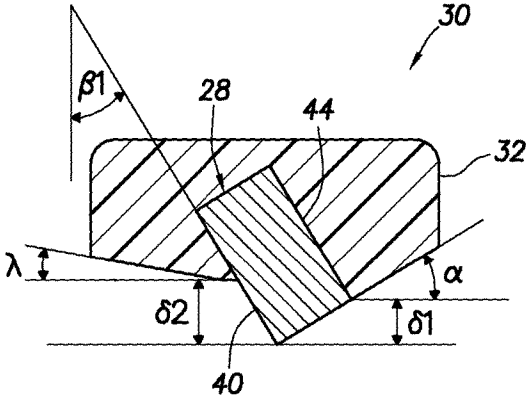

In FIG. 8, a combination of the techniques illustrated in FIGS. 6 & 7 is used. Each of the distances $\delta 1$ and $\delta 2$, and angles $\lambda$ and $\alpha$, can be varied to produce correspondingly varied depths of cut.

Figure 9:
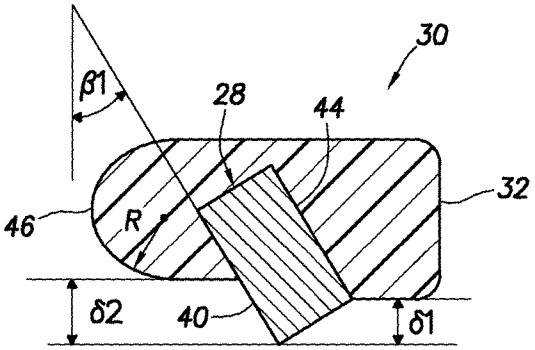

In FIG. 9, a leading end 46 of the substrate 32 is spherically rounded, with a radius R. The spaced distances $\delta 1$ and $\delta 2$ can be varied to produce correspondingly varied depths of cut, as with the configuration of FIG. 7.

Figure 11:
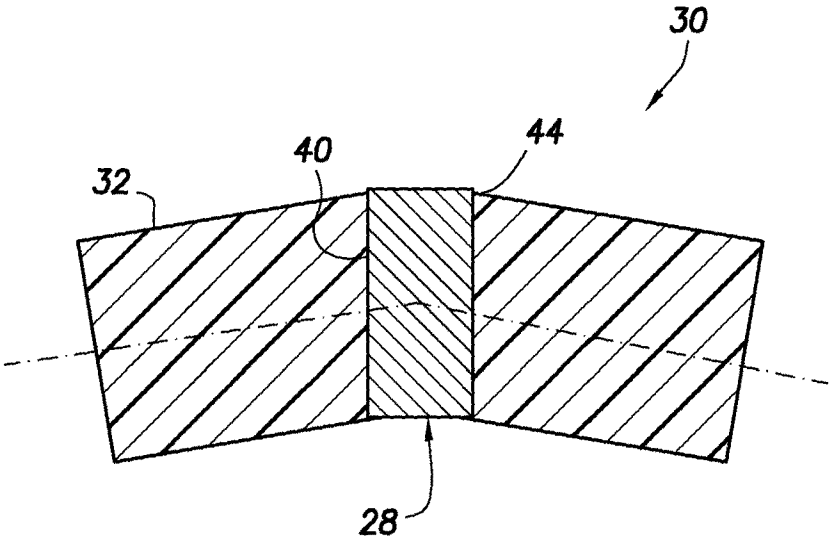
FIGS. 10 & 11 are representative side views of additional configurations of the cutter.
Figure 10:
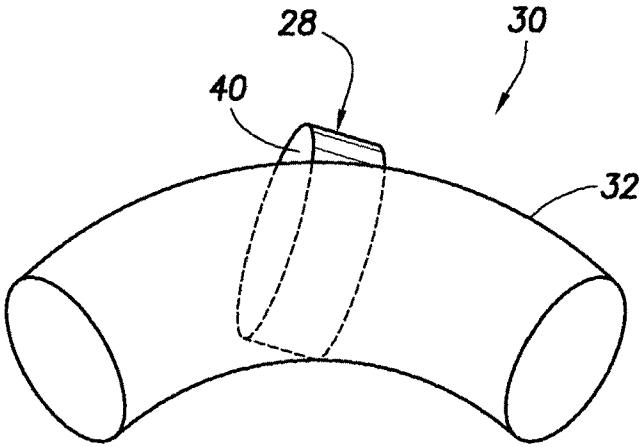

FIGS. 10 & 11 are representative side views of additional configurations of the cutter 30. In these configurations, the substrate 32 is shaped to match, or at least approximate, a path traversed by the cutter 30 as it displaces with the well tool 24.

In FIG. 10, the substrate 32 is in the shape of an arc. In FIG. 11, the substrate 32 is angled between leading and trailing sides of the cutting layer 28. Such an angled configuration may be used to approximate an arc, to conform to a well tool surface, or for another purpose.

Figure 13:
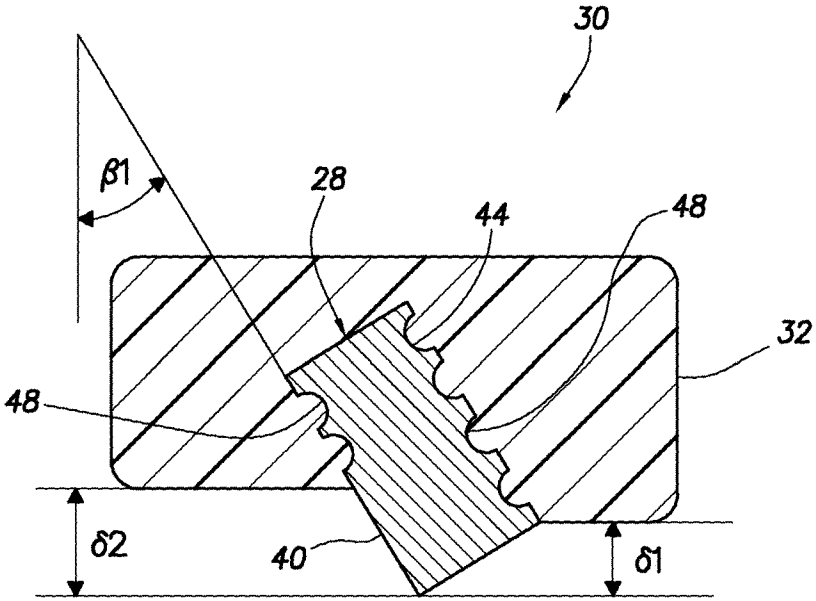
FIGS. 12 & 13 are representative cross-sectional views of additional configurations of the cutter.
Figure 12:
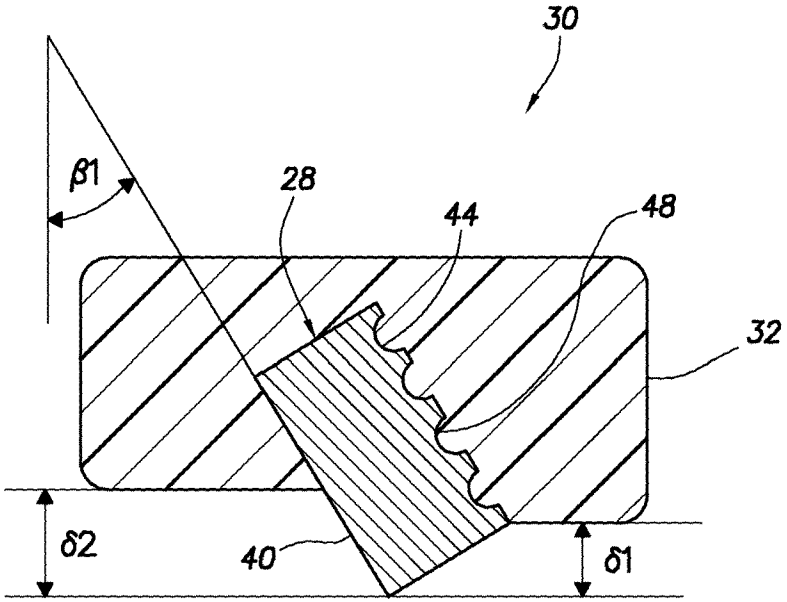

FIGS. 12 & 13 are representative cross-sectional views of additional configurations of the cutter 30. In these configurations, a non-planar interface 48 exists between the cutting layer 28 and the substrate 32. The non-planar interface 48 can help to prevent separation of the cutting layer 28 from the substrate 32.

In FIG. 12, the non-planar interface 48 is due to grooves formed on a surface of the trailing face 44 of the cutting layer 28. In FIG. 13, non-planar interfaces 48 are formed where the substrate 32 contacts both the leading and trailing faces 40, 44 of the cutting layer 28.

Figure 15:
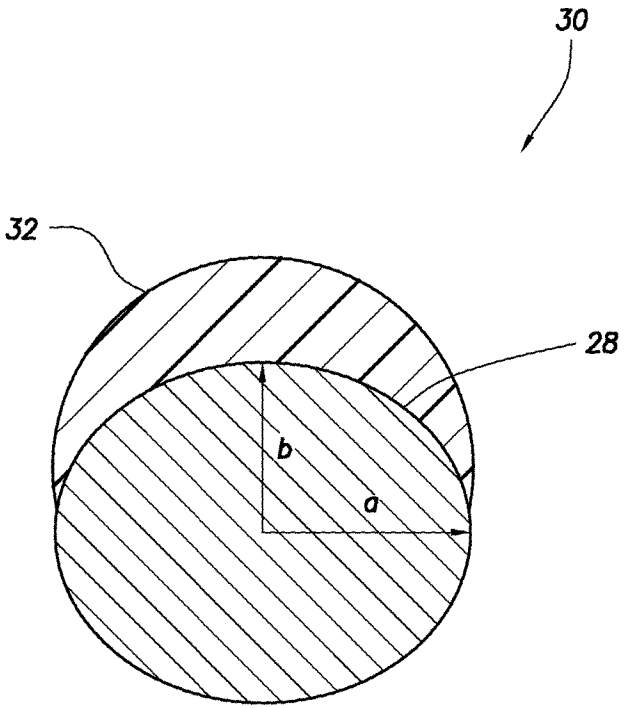
FIGS. 14 & 15 are representative end views of additional configurations of the cutter.
Figure 14:
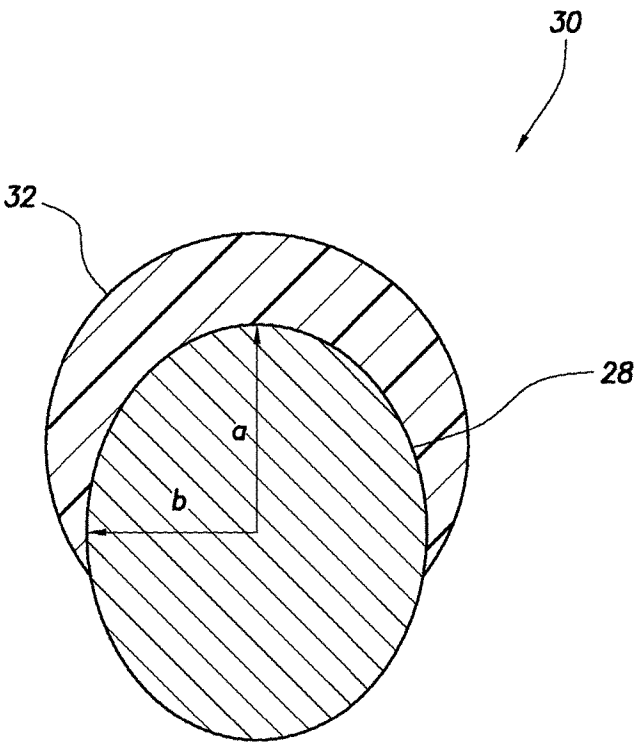

FIGS. 14 & 15 are representative end views of additional configurations of the cutter 30. In these configurations, the substrate 32 is in the form of a cylinder having a circular cross-section, but the cutting layer 28 is in the form of a cylinder having an elliptical cross-section (a major radius a being larger than a minor radius b of the elliptical cross-section).

In FIG. 14 the major radius a is vertical, and in FIG. 15 the major radius a is horizontal. These configurations demonstrate that it is not necessary for the cutting layer 28 and substrate 32 to have similar shapes, or for the cutting layer to have any particular orientation relative to the substrate.

Figure 17:
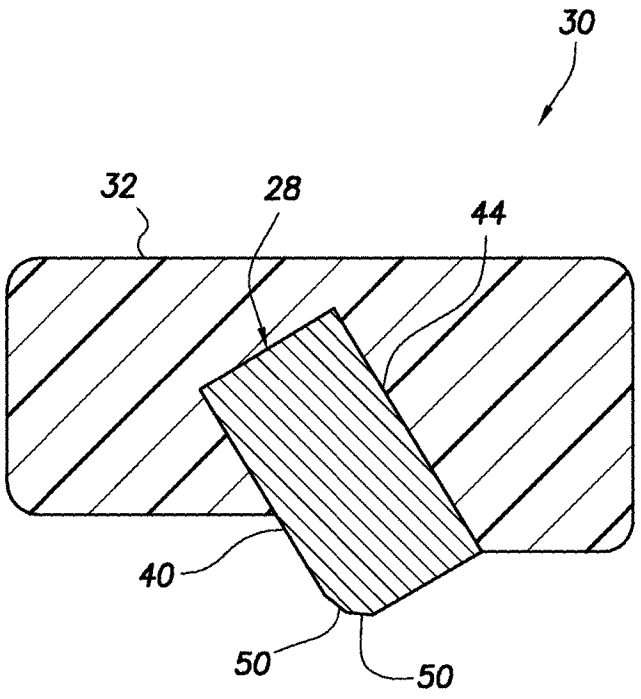
FIGS. 16-19 are representative cross-sectional views of additional configurations of the cutter.
Figure 16:
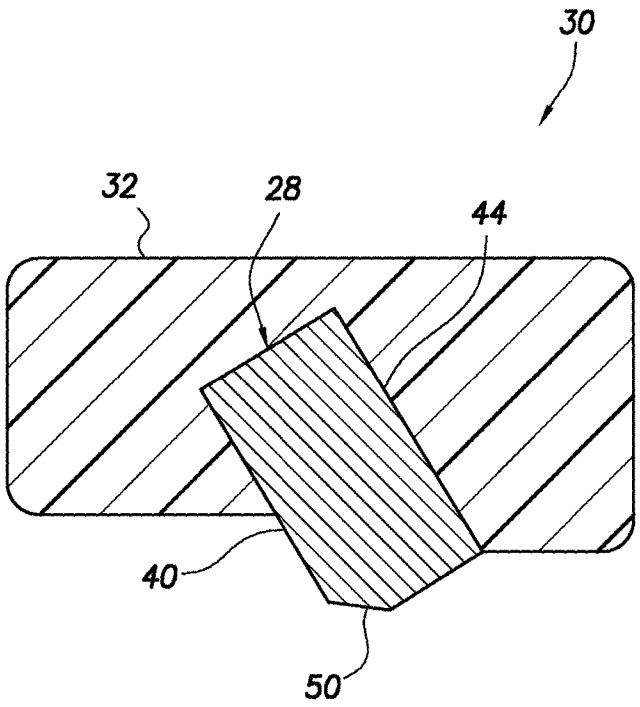

FIGS. 16 & 17 are representative cross-sectional views of additional configurations of the cutter 30. In these configurations, chamfers 50 are formed on a lower edge of the cutting layer 28, in order to reduce point loading and resulting chipping of the cutting layer. In FIG. 16 a single chamfer 50 is used, and in FIG. 17 multiple chamfers are used.

Figure 19:
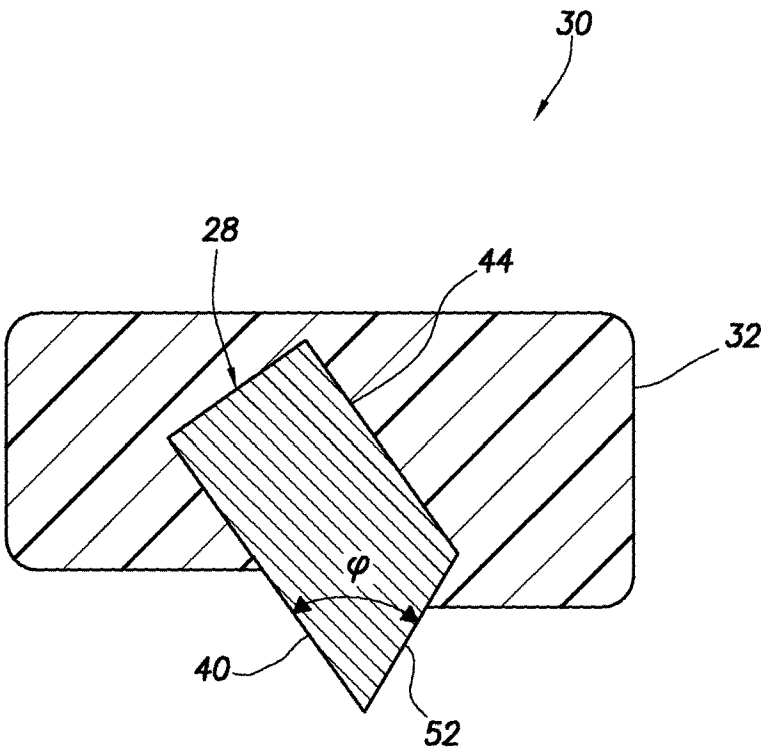
Figure 18:
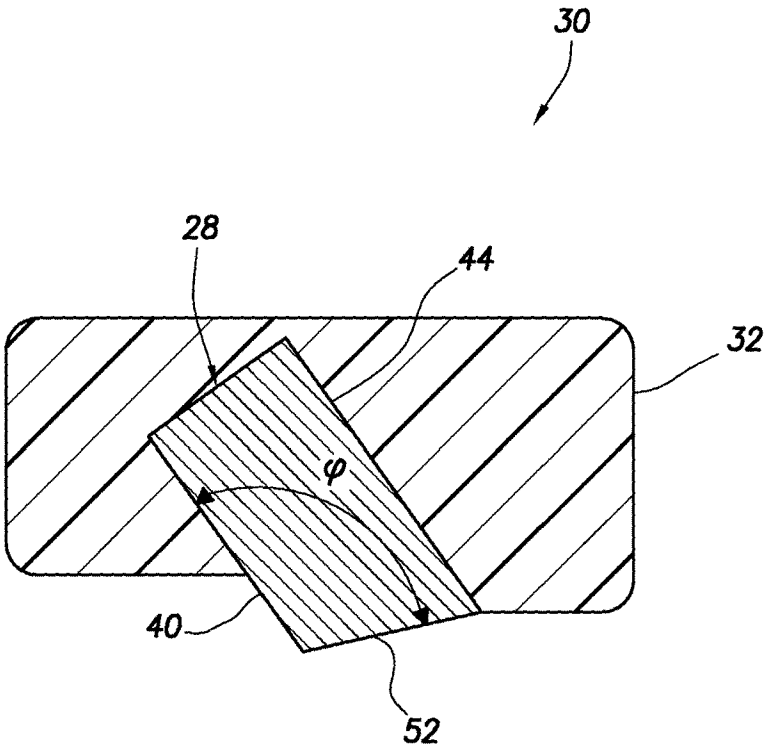

FIGS. 18 & 19 are representative cross-sectional views of additional configurations of the cutter 30. In these configurations, the leading face 40 is not perpendicular to a side face 52 of the cutting layer 28, thereby producing a cutting edge angle $\varphi$ that is not a right angle. In FIG. 18 the cutting edge angle $\varphi$ is greater than ninety degrees, and in FIG. 19 the cutting edge angle $\varphi$ is less than ninety degrees.

Figure 20:
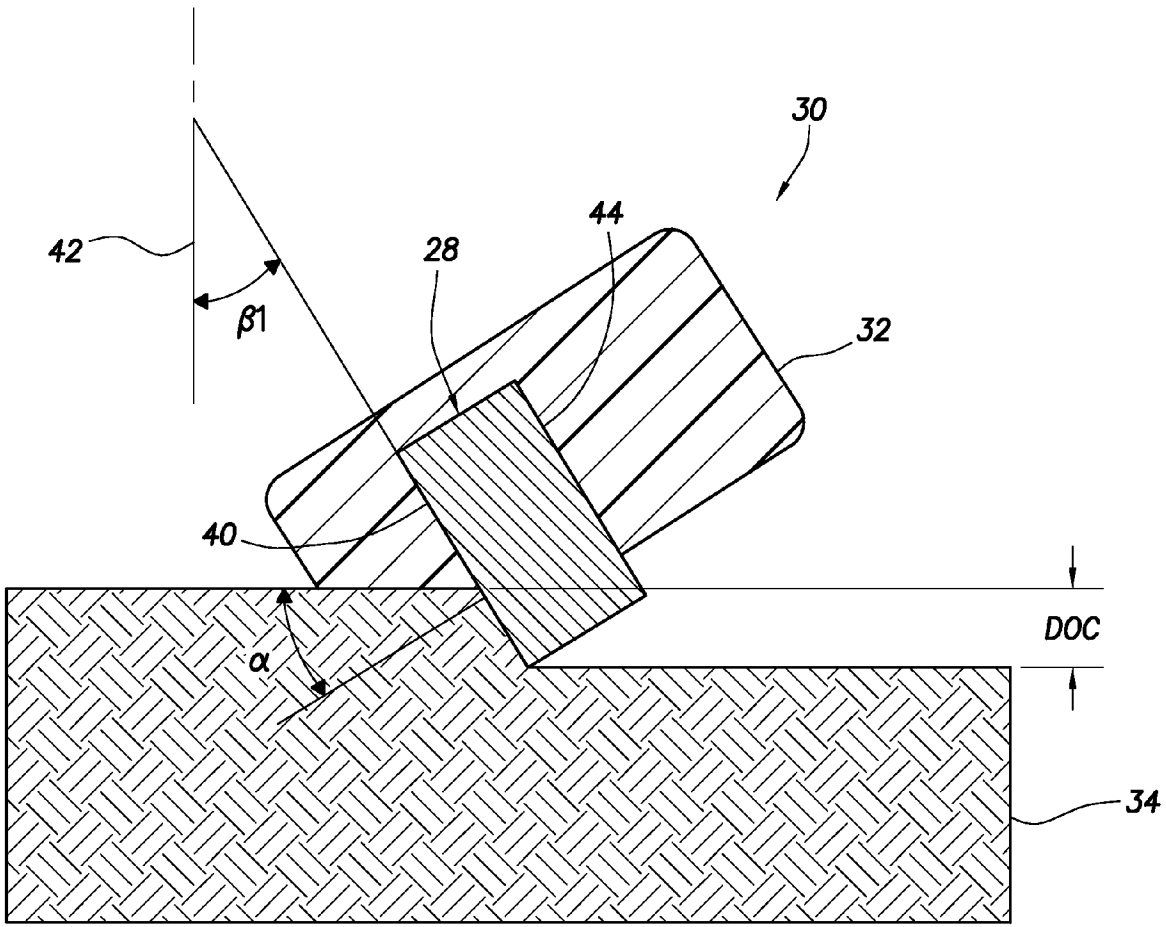
FIG. 20 is a representative cross-sectional view of an additional configuration of the cutter cutting into a formation rock.

FIG. 20 is a representative cross-sectional view of an additional configuration of the cutter 30 cutting into a formation rock 34. This configuration demonstrates that the back rake angle $\beta 1$ can be produced by techniques other than inclining the cutting layer 28 in the substrate 32.

In this example, the substrate 32 is itself inclined to produce the back rake angle $\beta 1$. The depth of cut DOC is determined by the combination of the distance by which the cutting layer 28 protrudes from the substrate 32, the back rake angle $\beta 1$ (in this example, the angle of inclination of the substrate) and the leading angle $\alpha$.

Figure 22:
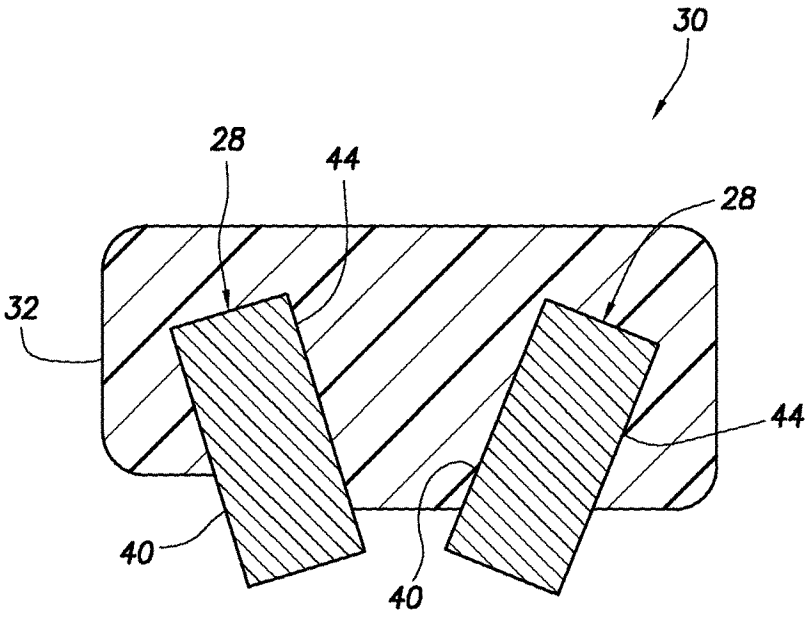
FIGS. 21 & 22 are representative cross-sectional views of additional configurations of the cutter.
Figure 21:
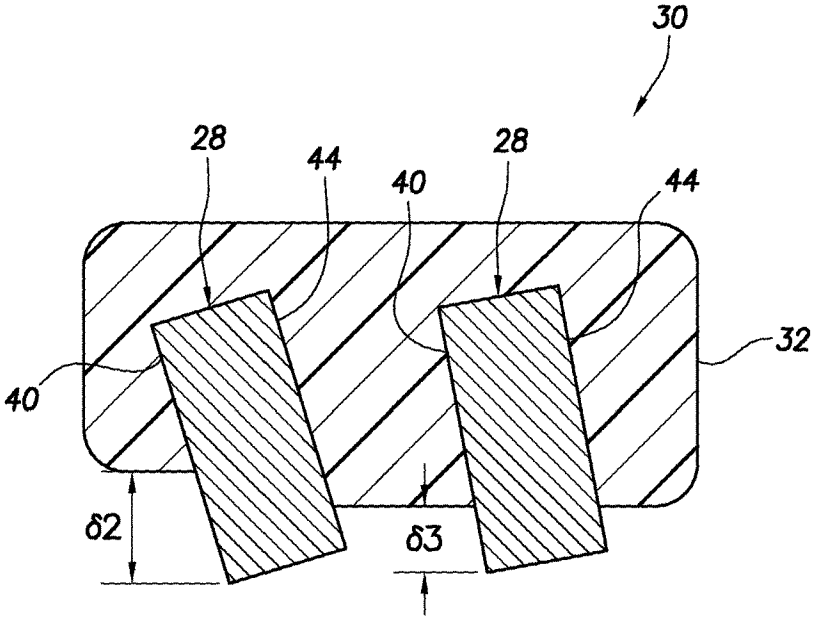

FIGS. 21 & 22 are representative cross-sectional views of additional configurations of the cutter 30. In these configurations, multiple cutting layers 28 are embedded in the substrate 32.

In FIG. 21, the cutting layers 28 are parallel to each other and spaced apart in the substrate 32. The cutting layers 28 protrude from the substrate 32 by different respective distances $\delta 2$ and $\delta 3$, which can be varied to produce a desired depth of cut of the cutter 30. The configuration of FIG. 22 is similar to that of FIG. 21, but the cutting layers 28 in the FIG. 22 configuration are not parallel to each other.

Figure 23:
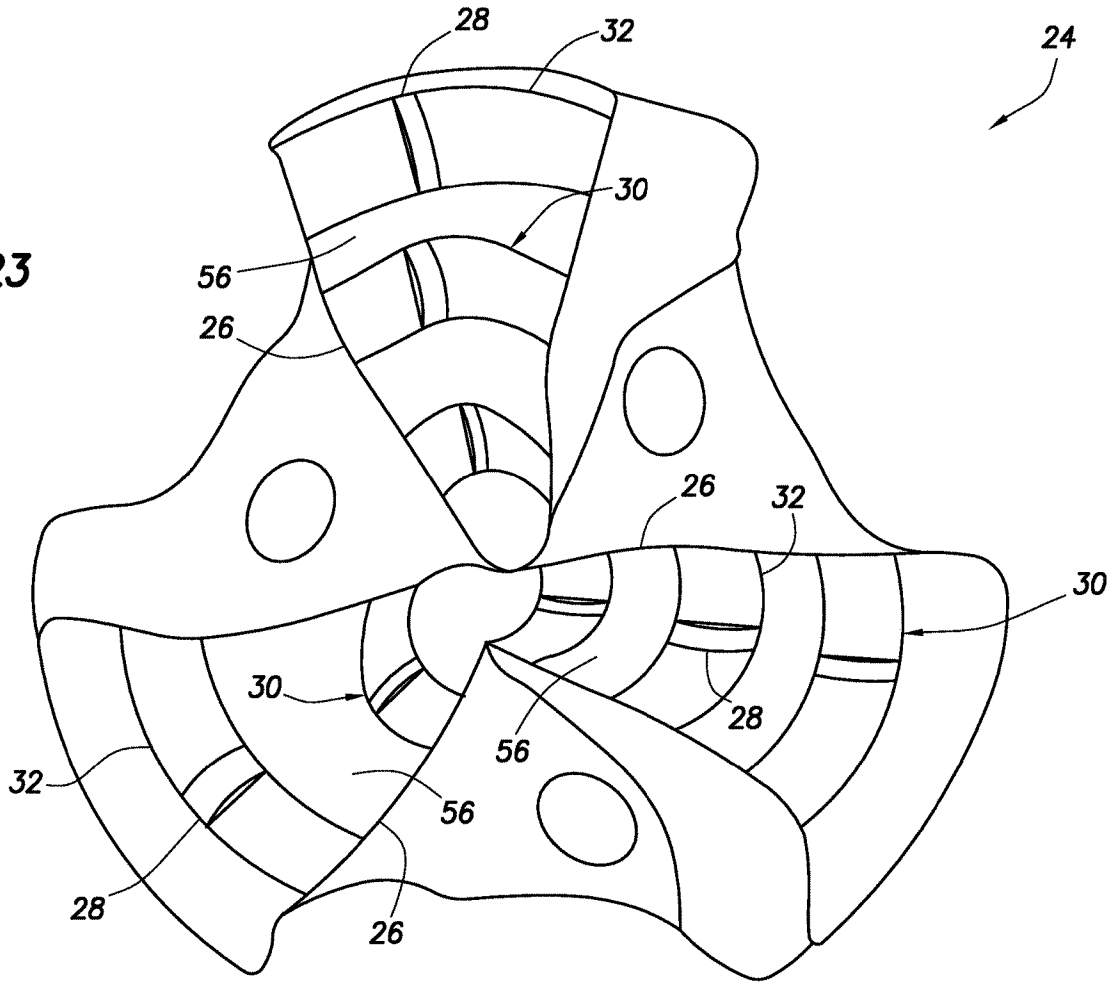
FIG. 23 is a representative end view of another configuration of the drill bit.

FIG. 23 is a representative end view of another configuration of the drill bit (well tool 24). In this configuration, the cutter 30 configuration of FIG. 10 is used. Multiple cutters 30 are secured to a cutting face 56 of each of three blades 26 of the well tool 24.

Note that the cutting layers 28 are positioned at an approximate middle of each of the cutting faces 56 of the blades 26. The substrate 32, extending both forward and rearward of the cutting layer 28 of each cutter 30, helps to stabilize the well tool 24 as it penetrates a formation rock.

Figure 24:
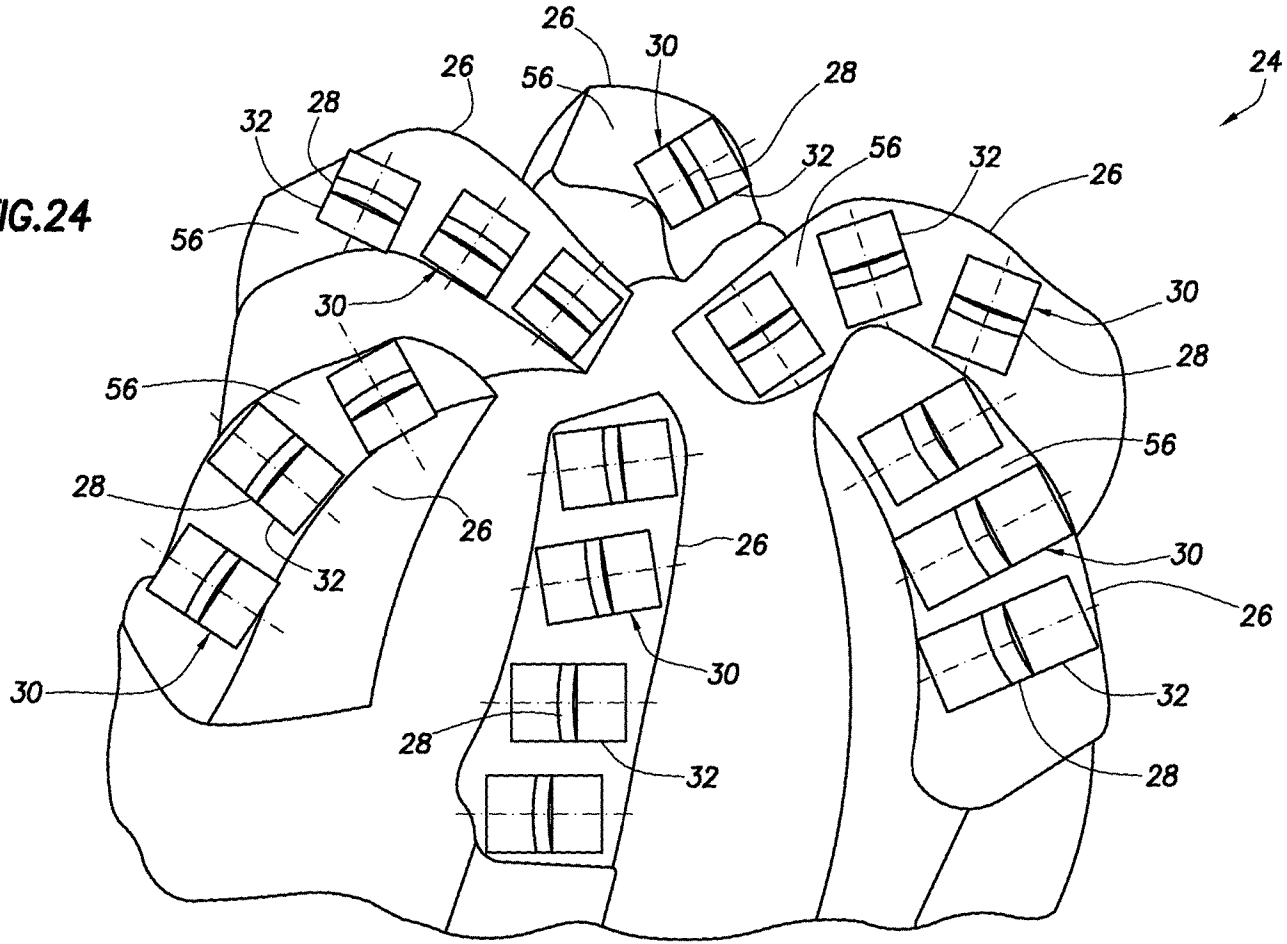
FIG. 24 is a representative perspective view of another configuration of the drill bit.

FIG. 24 is a representative perspective view of an upper end of another configuration of the drill bit (well tool 24). In this configuration, the cutter 30 configuration of FIGS. 3-5 is used. As in the configuration of FIG. 23, the cutting layers 28 are positioned at approximately a middle of the cutting faces 56 of the blades 26.

Figure 25:
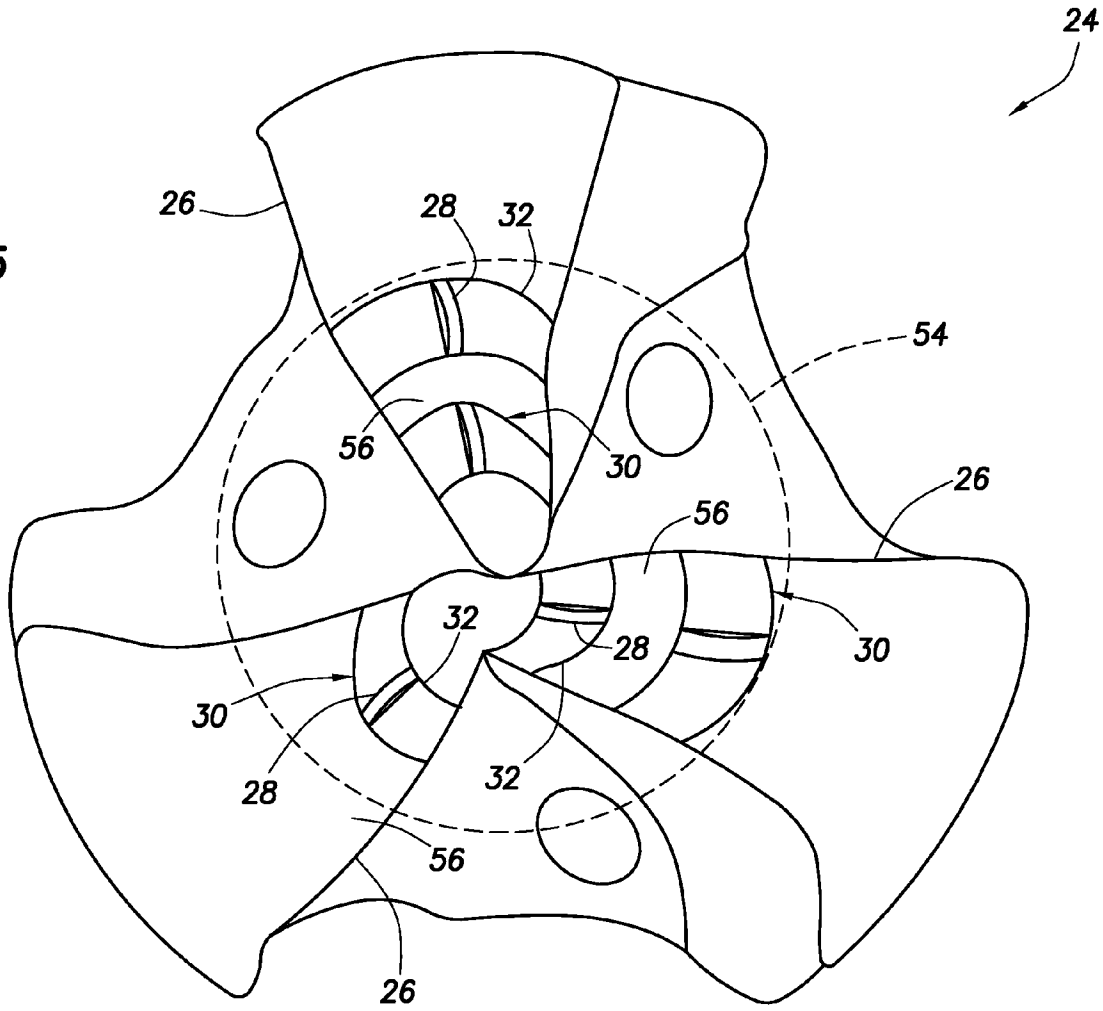
FIG. 25 is a representative end view of another configuration of the drill bit.

FIG. 25 is a representative end view of another configuration of the drill bit (well tool 24). In this configuration, the cutter 30 configuration of FIG. 10 is used in a cone cutter portion 54 of the cutting face 56 of each blade 26 of the drill bit.

In each of the FIGS. 23-25 configurations of the well tool 24, the cutters 30 can be configured so that the depth of cut of the cutters is produced as desired. Use of the substrate 32 on the leading side of the cutting layer 28, as well as on the trailing side of the cutting layer, provides additional flexibility and control over the depth of cut.

It may now be fully appreciated that the above disclosure provides significant advances to the art of constructing well tools with cutters. In examples described above, the cutters 30 are resistant to chipping and cracking of the cutting layers 28, and are resistant to separation of the cutting layers from the substrates 32. In addition, depth of cut can be more precisely controlled by varying certain parameters of the cutters 30.

The above disclosure provides to the art a well tool 24. In one example, the well tool 24 can comprise a cutter 30 including at least one cutting layer 28 and a substrate 32. The cutting layer 28 has a leading face 40, and the substrate 32 partially overlies the leading face 40.

The cutting layer 28 may be positioned approximately at a longitudinal middle of the substrate 32.

A depth of cut DOC of the cutter 30 can be determined by a distance δ1-3 by which the cutting layer 28 protrudes from the substrate 32.

The cutter 30 can comprise multiple cutting layers 28 in the substrate 32.

The cutting layer 28 may be embedded in the substrate 32.

The cutting layer 28 can have a trailing face 44 opposite the leading face 40, with the substrate 32 at least partially overlying the trailing face 44.

At least a portion of an interface 48 between the substrate 32 and the cutting layer 28 may be non-planar.

The cutting layer 28 can comprise a polycrystalline diamond compact (PDC). In other examples, other materials may be used in the cutting layer 28.

The substrate 32 can comprise a tungsten carbide material. In other examples, other materials may be used in the substrate 32.

The cutter 30 may be secured on a blade 26 of the well tool 24. In other examples, the cutter 30 can be secured to other portions of a well tool (such as, to a body or arm of the well tool).

A method of constructing a well tool 24 is also described above. In one example, the method can comprise: forming a cutter 30 by at least partially embedding at least one cutting layer 28 in a substrate 32; and securing the cutter 30 to the well tool 24.

The embedding step can include partially covering a leading face 40 of the cutting layer 28 with the substrate 32. The embedding step can include at least partially covering a trailing face 44 of the cutting layer 28 with the substrate 32.

The embedding step can include positioning the cutting layer 28 at an approximate longitudinal middle of the substrate 32.

The embedding step can include setting a depth of cut DOC of the cutter 30 by protruding the cutting layer 28 from the substrate 32 a predetermined distance δ1-3.

The forming step can include embedding multiple cutting layers 28 in the substrate 32.

The embedding step can include contacting the substrate 32 with a non-planar surface of the cutting layer 28.

The securing step can include securing the cutter 30 on a blade 26 of the well tool 24.

A drill bit (such as, well tool 24) is also described above. In one example, the drill bit can comprise a drill bit blade 26, and a cutter 30 secured on the drill bit blade 26. The cutter 30 can include a substrate 32 and at least one cutting layer 28 embedded in the substrate 32, with the substrate 32 overlying leading and trailing faces 40, 44 of the cutting layer 28.

The substrate 32 may only partially overly the leading face 40. The substrate 32 may completely overly the trailing face 44.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A well tool, including a cutter comprising:

at least two cutting layers, each cutting layer having a leading face which comprises the entire portion of the cutting layer that contacts and cuts into a rock formation when the cutter is displaced with the well tool in a normal direction corresponding to the direction for which the well tool is configured for use in cutting into the rock formation and a trailing face opposite the leading face; and a substrate in which the cutting layers are embedded so that each trailing face is completely covered and each leading face is partially covered, and which is in compression and supports the cutting layers when the cutter is displaced in the normal direction and when the cutter is displaced in a reverse direction opposite the normal direction, wherein a first cutting layer of the at least two cutting layers protrudes from the substrate a first distance and a second cutting layer of the at least two cutting layers protrudes from the substrate a second distance that is different than the first distance, and wherein the first distance and the second distance determine a depth of cut of the cutter.

2. The well tool of claim 1, wherein at least one cutting layer of the at least two cutting layers is positioned approximately at a longitudinal middle of the substrate.

3. The well tool of claim 1, wherein at least a portion of an interface between the substrate and at least one cutting layer of the at least two cutting layers is non-planar.

4. The well tool of claim 1, wherein at least one cutting layer of the at least two cutting layers comprises a polycrystalline diamond compact.

5. The well tool of claim 1, wherein the substrate comprises a tungsten carbide material.

6. The well tool of claim 1, wherein the cutter is secured on a blade of the well tool.

7. The well tool of claim 1, wherein the leading face and the trailing face of each cutting layer are parallel to each other.

8. The well tool of claim 1, wherein the leading face of each cutting layer is angled relative to a vertical line extending through the substrate and the cutting layer at a back rake angle.

9. The well tool of claim 1, wherein the cutting layers are spaced apart in the substrate.

10. The well tool of claim 1, wherein the cutting layers are parallel to each other.

11. The well tool of claim 1, wherein the cutting layers are not parallel to each other.

12. A method of constructing a well tool, the method comprising:

forming a cutter by at least partially embedding at least two cutting layers in a substrate, wherein each cutting layer has a leading face which comprises the entire portion of the cutting layer that contacts and cuts into a rock formation when the cutter is displaced with the well tool in a normal direction corresponding to the direction for which the well tool is configured for use in cutting into the rock formation and which is partially covered by the substrate and a trailing face opposite the leading face which trailing face is completely covered by the substrate, wherein the substrate is in compression and supports the cutting layers when the cutter is displaced in the normal direction and when the cutter displaced in a reverse direction opposite the normal direction, wherein a first cutting layer of the at least two cutting layers protrudes from the substrate a first distance and a second cutting layer of the at least two cutting layers protrudes from the substrate a second distance that is different than the first distance, and wherein the first distance and the second distance determine a depth of cut of the cutter; and securing the cutter to the well tool.

13. The method of claim 12, wherein the embedding further comprises positioning at least one cutting layer of the two cutting layers at an approximate longitudinal middle of the substrate.

14. The method of claim 12, wherein the embedding further comprises contacting the substrate with a non-planar surface of at least one cutting layer of the two cutting layers.

15. The method of claim 12, wherein at least one cutting layer of the two cutting layers comprises a polycrystalline diamond compact.

16. The method of claim 12, wherein the substrate comprises a tungsten carbide material.

17. The method of claim 12, wherein the securing further comprises securing the cutter on a blade of the well tool.

18. The method of claim 12, wherein the cutting layers are spaced apart in the substrate.

19. The method of claim 12, wherein the cutting layers are parallel to each other.

20. The method of claim 12, wherein the cutting layers are not parallel to each other.

21. A drill bit, comprising:

a drill bit blade; and a cutter secured on the drill bit blade, the cutter including:

at least two cutting layers, wherein each cutting layer has a leading face which comprises the entire portion of the cutting layer that contacts and cuts into a rock formation when the cutter is displaced with the drill bit in a normal direction corresponding to the direction for which the well tool is configured for use in cutting into the rock formation and a trailing face opposite the leading face; and a substrate in which the cutting layer is embedded so that the trailing face is completely covered and the leading face is partially covered, and which is in compression and supports the cutting layer when the cutter is displaced in the normal direction and when the cutter displaced in a reverse direction opposite the normal direction, wherein a first cutting layer of the at least two cutting layers protrudes from the substrate a first distance and a second cutting layer of the at least two cutting layers protrudes from the substrate a second distance that is different than the first distance, and wherein the first distance and the second distance determine a depth of cut of the cutter.

22. The drill bit of claim 21, wherein at least one cutting layer of the at least two cutting layers is positioned approximately at a longitudinal middle of the substrate.

23. The drill bit of claim 21, wherein at least a portion of an interface between the substrate and at least one cutting layer of the at least two cutting layers is non-planar.

24. The drill bit of claim 21, wherein at least one cutting layer of the at least two cutting layers comprises a polycrystalline diamond compact.

25. The drill bit of claim 21, wherein the substrate comprises a tungsten carbide material.

26. The drill bit of claim 21, wherein the leading face and the trailing face of each cutting layer are parallel to each other.

27. The drill bit of claim 21, wherein the cutting layers are spaced apart in the substrate.

28. The method of claim 21, wherein the cutting layers are parallel to each other.

29. The method of claim 21, wherein the cutting layers are not parallel to each other.

* * * * *